US012246900B2

(12) United States Patent
Watanabe

(10) Patent No.: US 12,246,900 B2
(45) **Date of Patent: *Mar. 11, 2025**

(54) CONTAINER

(71) Applicant: Kao Corporation, Tokyo (JP)

(72) Inventor: Shinji Watanabe, Sumida-ku (JP)

(73) Assignee: Kao Corporation, Tokyo (JP)

( * ) Notice: Subject to any disclaimer, the term of this patent is extended or adjusted under 35 U.S.C. 154(b) by 282 days.

This patent is subject to a terminal disclaimer.

(21) Appl. No.: 17/905,801

(22) PCT Filed: Mar. 13, 2020

(86) PCT No.: PCT/JP2020/011230
§ 371 (c)(1),
(2) Date: Sep. 7, 2022

(87) PCT Pub. No.: WO2021/181692
PCT Pub. Date: Sep. 16, 2021

(65) Prior Publication Data

US 2023/0114929 A1 Apr. 13, 2023

(51) Int. Cl.
*B65D 75/32* (2006.01)
*A47K 5/12* (2006.01)
(Continued)

(52) U.S. Cl.
CPC ..... *B65D 75/322* (2013.01); *A47K 5/1205* (2013.01); *B65D 75/008* (2013.01); *B65D 75/5883* (2013.01); *B65D 77/04* (2013.01)

(58) Field of Classification Search
CPC ..... B65D 75/322; B65D 75/008; B65D 75/5883; B65D 77/04; A47K 5/1205
(Continued)

(56) References Cited

U.S. PATENT DOCUMENTS 5,788,121 A 8/1998 Sasaki et al.
11,858,708 B2 * 1/2024 Otsuka ..... B65D 75/008
(Continued)

FOREIGN PATENT DOCUMENTS

CN 1919693 A 2/2007
CN 109641680 A 4/2019
(Continued)

OTHER PUBLICATIONS

Extended European Search Report issued Nov. 6, 2023, in corresponding European Patent Application No. 20924406.0, 10 pages.
(Continued)

*Primary Examiner* — Jes F Pascua
(74) *Attorney, Agent, or Firm* — Oblon, McClelland, Maier & Neustadt, L.L.P.

(57) ABSTRACT

A container includes a container main body that is composed of a main-body forming sheet member and surrounds a containing portion, wherein the container main body includes a first surface portion, a second surface portion that is arranged so as to face the first surface portion with the containing portion being arranged therebetween, and a gusset portion which connects the first surface portion and the second surface portion to each other. The gusset portion is provided with a discharge port that discharges a contents from the containing portion. The main-body forming sheet member includes a main-body sealing portion in which a plurality of film layers are attached to each other, a non-attached region in which the plurality of film layers are partially non-attached to each other, and a filling portion in which a filler can be enclosed between layers of the plurality of film layers in the non-attached region.

20 Claims, 11 Drawing Sheets

(51) Int. Cl.
*B65D 75/00* (2006.01)
*B65D 75/58* (2006.01)
*B65D 77/04* (2006.01)

(58) Field of Classification Search
USPC ..... 383/116
See application file for complete search history.

(56) References Cited

U.S. PATENT DOCUMENTS

| | | | | |
|---|---|---|---|---|
| 2013/0248540 | A1 | 9/2013 | Darby et al. | |
| 2015/0122373 | A1 | 5/2015 | Bourgeois et al. | |
| 2019/0168941 | A1 | 6/2019 | Otsuka et al. | |
| 2019/0185213 | A1 | 6/2019 | Komada et al. | |
| 2020/0324504 | A1 | 10/2020 | Takano et al. | |
| 2021/0163181 | A1 | 6/2021 | Kodama et al. | |
| 2021/0372567 | A1* | 12/2021 | Nakamoto | F17C 5/06 |
| 2023/0072263 | A1* | 3/2023 | Takano | B65D 75/008 |
| 2023/0108758 | A1* | 4/2023 | Shiba | B65D 75/5877 383/109 |
| 2023/0173782 | A1* | 6/2023 | Kano | B31B 70/261 493/194 |
| 2023/0174282 | A1* | 6/2023 | Takano | B65D 75/26 383/3 |

FOREIGN PATENT DOCUMENTS

| | | | | |
|---|---|---|---|---|
| CN | 109641681 | A | 4/2019 | |
| CN | 109641687 | A | 4/2019 | |
| EP | 3 593 984 | A1 | 1/2020 | |
| JP | 8-207939 | A | 8/1996 | |
| JP | 2015-726 | A | 1/2015 | |
| JP | 2016-535707 | A | 11/2016 | |
| JP | 2016-216046 | A | 12/2016 | |
| JP | 6090908 | B2 | 3/2017 | |
| JP | 2018-144860 | A | 9/2018 | |
| TW | 252083 | B | 7/1995 | |
| WO | WO 96/19396 | A1 | 6/1996 | |
| WO | WO-2018164117 | A1 * | 9/2018 | B31B 70/008 |
| WO | WO-2019065769 | A1 * | 4/2019 | B65D 33/02 |
| WO | WO-2021181690 | A1 * | 9/2021 | |
| WO | WO-2021181692 | A1 * | 9/2021 | A47K 5/1205 |
| WO | WO-2022230025 | A1 * | 11/2022 | B65B 3/02 |
| WO | WO-2022254546 | A1 * | 12/2022 | B05B 11/00 |
| WO | WO-2023037474 | A1 * | 3/2023 | |

OTHER PUBLICATIONS

International Search Report with partial English translation mailed on Apr. 14, 2020 in PCT/JP2020/011230 filed on Mar. 13, 2020, 10 pages).

* cited by examiner

CONTAINER

CROSS-REFERENCE TO RELATED APPLICATION

The present application is a 35 U.S.C. § 371 national stage application of International patent application PCT/JP2020/011230, filed Mar. 13, 2020. The entire content of this application is incorporated herein by reference.

TECHNICAL FIELD

The present invention relates to a container.

BACKGROUND ART

A container of such a structure is described in, for example, Patent Document 1, that a plurality of film layers are laminated, a filler such as air is enclosed between the layers, and a filling portion is formed.

The container of Patent Document 1 includes a top gusset portion in which a spout member has been provided, and an annular filling portion is formed on the periphery of the plate portion of the spout member.

Related Art Document

Patent Document 1 U.S. Patent Application Publication No. 2013/0248540

SUMMARY OF THE INVENTION

The present invention relates to a container that includes: a containing portion which accommodates contents; and a container main body that is composed of a main-body forming sheet member in which a plurality of film layers are laminated, and that surrounds the containing portion, wherein the container main body includes a first surface portion, a second surface portion that is arranged so as to face the first surface portion with the containing portion being arranged therebetween, and a gusset portion that connects the first surface portion and the second surface portion to each other; the gusset portion is provided with a discharge port that discharges the contents from the containing portion; and the main-body forming sheet member includes a main-body sealing portion in which the plurality of film layers are attached to each other, and a non-attached region in which the plurality of film layers are partially non-attached to each other, and also includes a filling portion in which a filler can be enclosed between layers of the plurality of film layers in the non-attached region, wherein the filling portion includes a gusset portion filling portion that is arranged in the gusset portion; and the main-body sealing portion includes a gusset portion peripheral edge sealing piece which is arranged along a peripheral edge of the gusset portion, and the gusset portion peripheral edge sealing piece defines an outer edge of the gusset portion filling portion.

In addition, the present invention relates to a container that includes a containing portion which accommodates a contents, and a container main body that is composed of a main-body forming sheet member in which a plurality of film layers are laminated, and that surrounds the containing portion, wherein the container main body includes a first surface portion, a second surface portion that is arranged so as to face the first surface portion with the containing portion being arranged therebetween, and a gusset portion that connects the first surface portion and the second surface portion to each other; the gusset portion is provided with a discharge port that discharges the contents from the containing portion; and the main-body forming sheet member includes a main-body sealing portion in which the plurality of film layers are attached to each other, and a non-attached region in which the plurality of film layers are partially non-attached to each other, and also includes a filling portion in which a filler can be enclosed between layers of the plurality of film layers in the non-attached region; the filling portion includes a gusset portion filling portion that is arranged in the gusset portion; and the container main body includes a gusset portion peripheral edge sealing piece that includes a first surface portion side sealing piece that includes an attached portion between a peripheral edge portion of the gusset portion and a peripheral edge portion of the first surface portion, and a second surface portion side sealing piece that includes an attached portion between a peripheral edge portion of the gusset portion and a peripheral edge portion of the second surface portion, and a pair of lateral sealing pieces that include an attached portion between the peripheral edge portion of the first surface portion and the peripheral edge portion of the second surface portion, wherein the gusset portion filling portion has an inner edge on a side close to the discharge port, and extends downward from the inner edge toward an intersection point of the first surface portion side sealing piece, the second surface portion side sealing piece, and the lateral sealing piece.

DETAILED DESCRIPTION OF THE INVENTION

Figure 1:
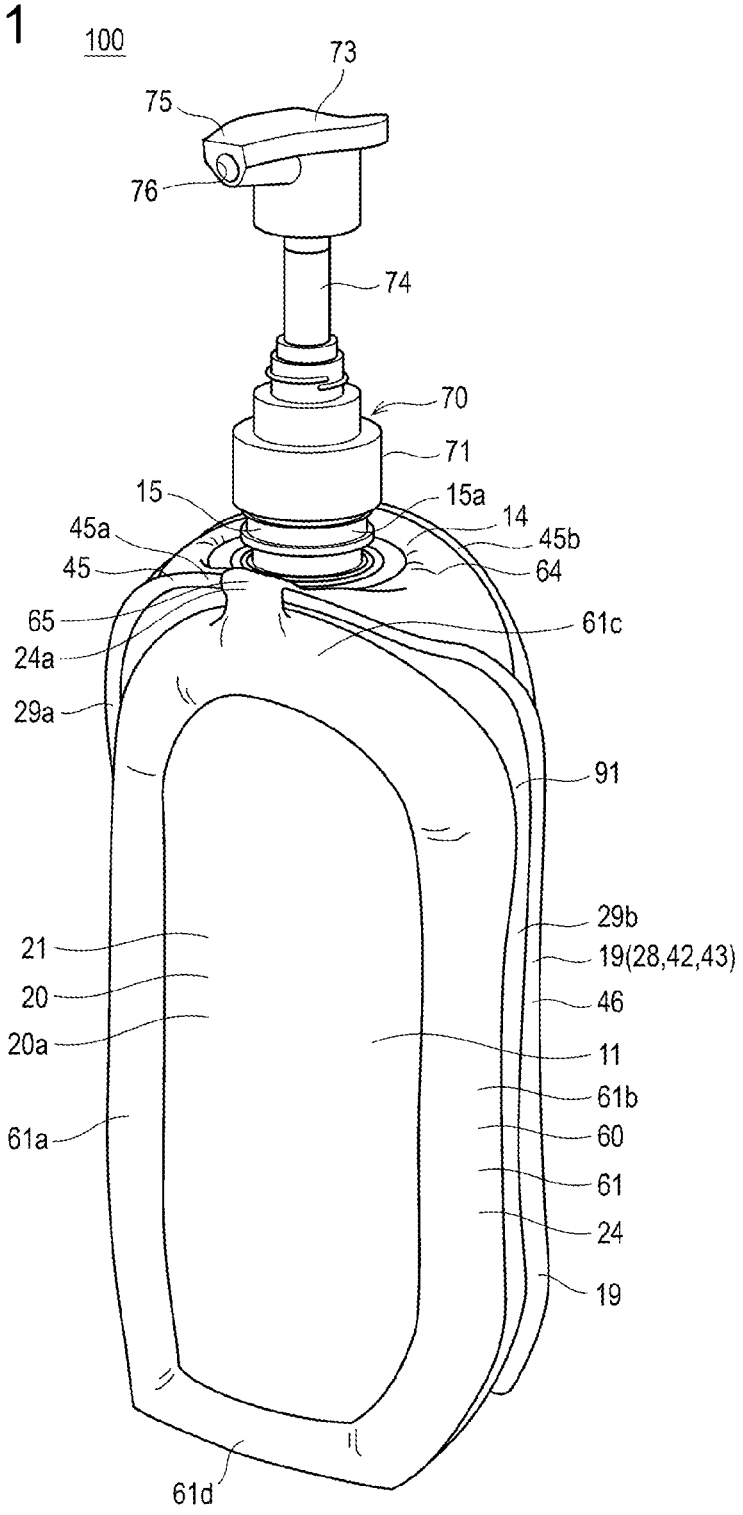
FIG. 1 shows a perspective view of a container according to an embodiment, in a state in which a filler is enclosed.

According to studies by the present inventor, the container of Patent Document 1 still has room for improvement regarding a shape keeping property of the top gusset portion.

The present invention relates to a container having a structure that can realize a satisfactory shape keeping property of a gusset portion.

A preferable embodiment of the present invention will be described below with reference to the drawings. For information, in all the drawings, the same constituent components are denoted by the same reference characters, and overlapping description will not be repeated.

The container 100 according to the present embodiment includes a containing portion 17 that accommodates contents 18, and a container main body 20 that is composed of a main-body forming sheet member 21 in which a plurality of film layers are laminated and surrounds the containing portion 17. The container main body 20 includes a first surface portion 20*a*, a second surface portion 20*b* that is arranged so as to face the first surface portion 20*a* with the containing portion 17 being arranged therebetween, and a gusset portion (top gusset 14) that connects the first surface portion 20*a* and the second surface portion 20*b* to each other.

The gusset portion is provided with a discharge port that discharges the contents 18 from the containing portion 17.

The main-body forming sheet member 21 includes main-body sealing portions 26 and 28 in which the plurality of film layers are attached to each other, and a non-attached region 24 in which the plurality of film layers are partially non-attached to each other, and also includes a filling portion 60 in which a filler can be enclosed between layers of the plurality of film layers in the non-attached region 24.

The filling portion 60 includes a gusset portion filling portion 64 that is arranged in the gusset portion; and the main-body sealing portions 26 and 28 include a gusset portion peripheral edge sealing piece 45 which is arranged along a peripheral edge of the gusset portion. The gusset portion peripheral edge sealing piece 45 defines an outer edge of the gusset portion filling portion 64.

Here, the gusset portion peripheral edge sealing piece 45 includes at least a standing piece that stands toward the outside of the container main body 20. The gusset portion peripheral edge sealing piece 45 may be composed of only the standing piece, or may include the standing piece and the main-body sealing portion 26 which is continuous with the standing piece (which is positioned more inside than the standing piece) and does not stand. In the case of the present embodiment, the gusset portion peripheral edge sealing piece 45 includes a standing piece, and the main-body sealing portion 26 that is continuous with the standing piece. In addition, in the entire region of the gusset portion peripheral edge sealing piece 45, the gusset portion peripheral edge sealing piece 45 may be composed of only the standing piece, or in the entire region of the gusset portion peripheral edge sealing piece 45, the gusset portion peripheral edge sealing piece 45 may include the standing piece and the main-body sealing portion 26 that does not stand. Alternatively, in one part in the extending direction of the gusset portion peripheral edge sealing piece 45, the gusset portion peripheral edge sealing piece 45 is composed of only the standing piece, but on the other hand, in other parts in the extending direction of the gusset portion peripheral edge sealing piece 45, the gusset portion peripheral edge sealing piece 45 may include the standing piece and the main-body sealing portion 26 which does not stand.

According to the present embodiment, the container 100 has the gusset portion peripheral edge sealing piece 45 arranged along the peripheral edge of the gusset portion in which the discharge port is provided, and accordingly has a structure in which the peripheral edge portion of the gusset portion is reinforced by the gusset portion peripheral edge sealing piece 45.

Moreover, the outer edge of the gusset portion filling portion 64 which is arranged in the gusset portion is defined by the gusset portion peripheral edge sealing piece 45. In other words, the gusset portion filling portion 64 is formed so as to have a width reaching the gusset portion peripheral edge sealing piece 45, and the gusset portion is reinforced by the gusset portion filling portion 64 over such a width.

Therefore, in a state in which the filler is enclosed in the gusset portion filling portion 64, a structure can be realized in which the gusset portion is satisfactorily reinforced by the gusset portion peripheral edge sealing piece 45 and the gusset portion filling portion 64, and a satisfactory shape keeping property (form stability) of the gusset portion can be realized. Thereby, for example, when the container 100 is a pump container, it becomes possible to stably perform a pumping operation.

In the case of the present embodiment, the container 100 has a bottom gusset 13 (FIG. 2, FIG. 4 and FIG. 5) as a bottom portion, and can stand by itself in a state in which the bottom gusset 13 is mounted on a horizontal mounting surface.

Figure 2:
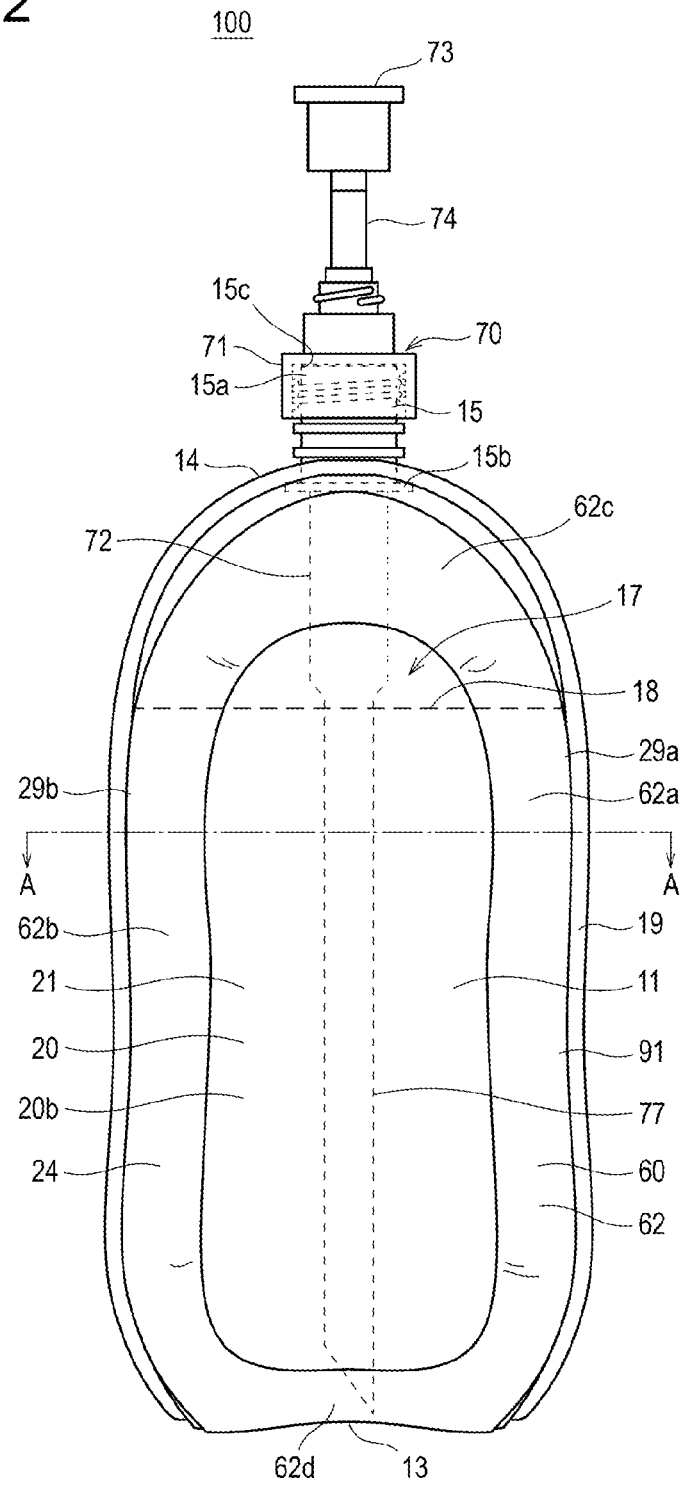
FIG. 2 shows a rear view of the container according to the embodiment, in a state in which the filler is enclosed.
Figure 4:
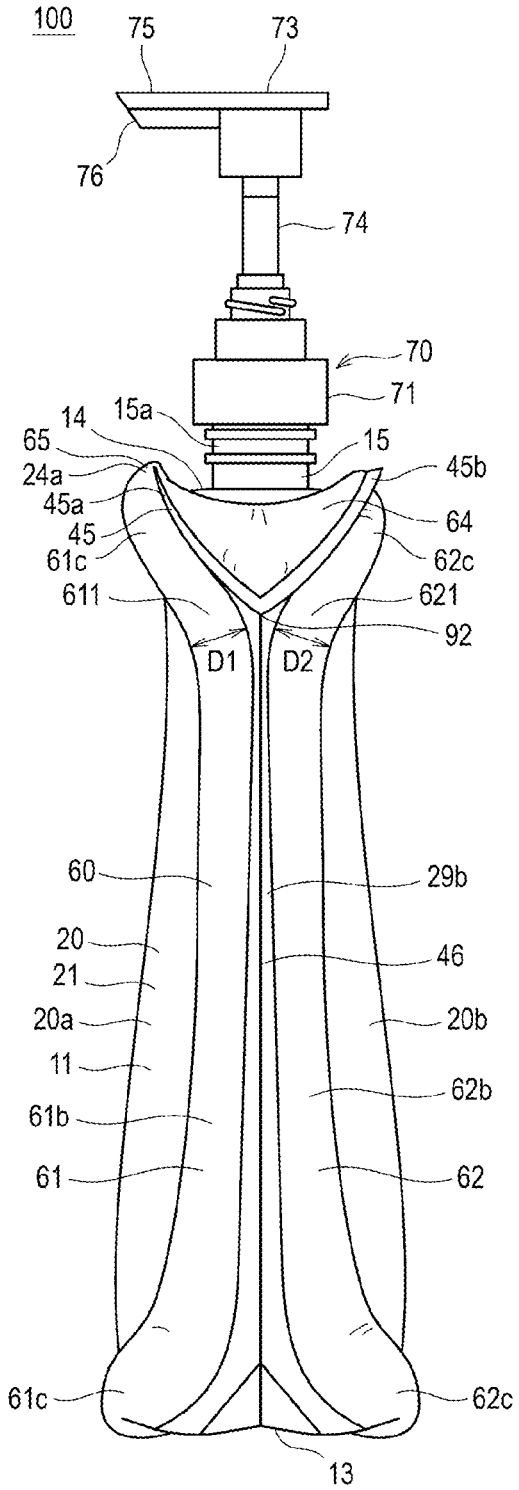
FIG. 4 shows a side view of the container according to the embodiment, in a state in which the filler is enclosed.
Figure 5:
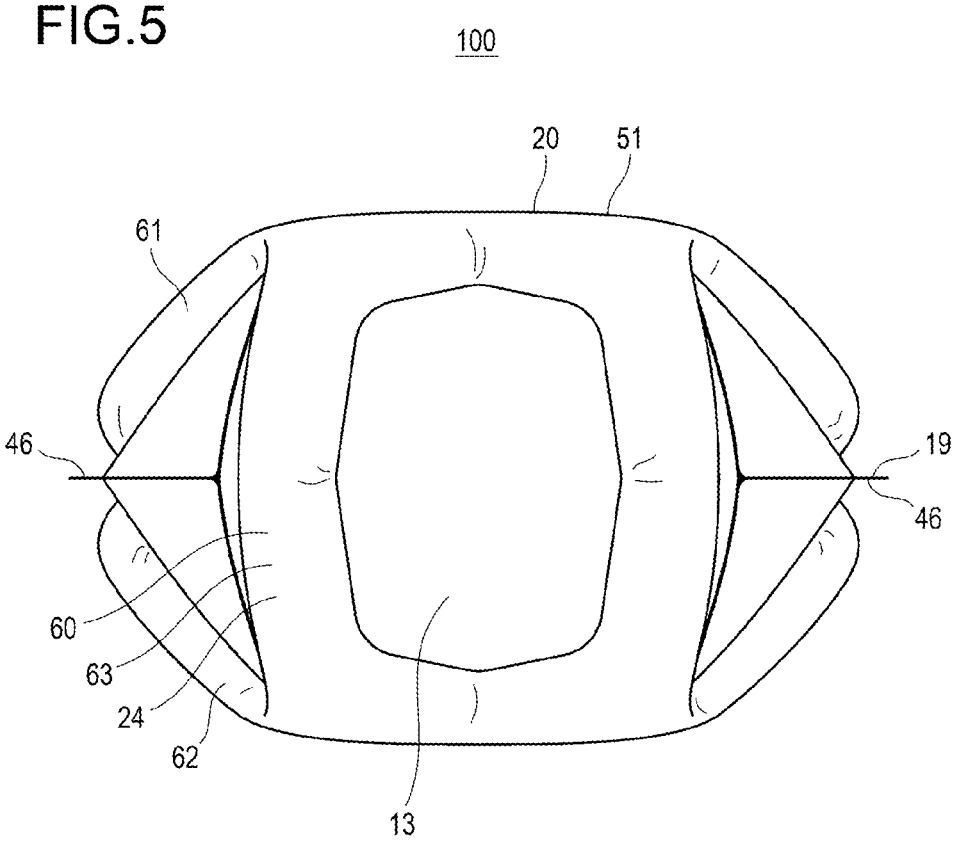
FIG. 5 shows a bottom view of the container according to the embodiment, in a state in which the filler is enclosed.

In the present embodiment, a description on a positional relationship (up-down relationship or the like) of each constituent component in the container 100 is a description on a positional relationship in a state in which the container 100 is self-supported as shown in FIG. 1, FIG. 2 and FIG. 4, unless otherwise specified. However, the positional relationship in these descriptions does not necessarily coincide with the positional relationship at the time when the container 100 is used or manufactured.

In addition, in the positional relationship of each of the constituent components in the container 100, a positional relationship shown in each figure is described in some cases.

A front surface side of the container 100 (the back side of the paper surface in FIG. 2, and the left side in FIG. 4) is referred to as a forward direction, and a back surface side of the container 100 (the front side of the paper surface in FIG. 2, and the right side in FIG. 4) is referred to as a rearward direction; and a left side facing the front surface of the container 100 (right side in FIG. 2, and back side of the paper surface in FIG. 4) is referred to as a leftward direction, and a right side facing the front surface of the container 100 (left side in FIG. 2 and front side of the paper surface in FIG. 4) is referred to as a rightward direction. The left and right direction of the container 100 is referred to as a widthwise direction, in some cases.

In the present invention, a type of the contents 18 is not particularly limited. Examples of the contents 18 include a shampoo, a hair conditioner, a body soap, a detergent, a bleach, a softener, a beverage, a food, an engine oil and a chemical agent.

In addition, the contents 18 may be a liquid (including a material having a form of paste), or a solid (for example, a material having a form of particle (including a material having a form of grain), or a material having a form of powder).

In the case of the present embodiment, the contents 18 is, for example, the liquid.

In the case where the contents 18 is the liquid, a viscosity of the contents 18 is preferably equal to or higher than 1 mPas and equal to or lower than 120000 mPas (when measured with a B-type viscometer; for example, measured with a viscometer TV-10, a viscometer TVB-10 manufactured by Toki Sangyo Co., Ltd., or the like), at 30 degrees centigrade, for example; and is more preferably equal to or higher than 1 mPas and equal to or lower than 60000 mPas.

In the case of the present embodiment, the container main body 20 is formed into a bag shape that has a body portion 11, the top gusset 14 which is arranged on the upper side of the body portion 11, and the bottom gusset 13 which is arranged on a lower side of the body portion 11. However, the present invention is not limited to this example, and the container main body 20 may not have the top gusset 14 or may not have the bottom gusset 13.

The container main body 20 surrounds the containing portion 17. In the case of the present embodiment, the container main body 20 surrounds an inner bag 40. In other words, in the case of the present embodiment, the container 100 includes the inner bag 40 that is surrounded by the container main body 20, and the inner bag 40 has the containing portion 17.

The container main body 20 constitutes an outer shell of the container 100. In the following, the body portion 11, the top gusset 14, and the bottom gusset 13 of the container main body 20 are referred to as the body portion 11, the top gusset 14, and the bottom gusset 13 of the container 100, respectively, in some cases.

The shape of the front surface of the body portion 11 is not particularly limited, but in the case of the present embodiment, has a vertically long shape of which the width size is approximately constant, and the upper edge of the body portion 11 is formed in an arc shape that is convex upward, as shown in FIG. 2, for example.

As shown in FIG. 4, the body portion 11 has a first surface portion 20*a* (panel of front side) and a second surface portion 20*b* (panel of rear side) which face each other with the containing portion 17 being arranged therebetween. The first surface portion 20*a* is positioned on the front surface side, and the second surface portion 20*b* is positioned on the back surface side (see also FIG. 1 and FIG. 2).

The first surface portion 20*a* is formed symmetrically in the left and right direction, for example, and the second surface portion 20*b* is also formed symmetrically in the left and right direction, for example. In addition, the first surface portion 20*a* and the second surface portion 20*b* are formed to be symmetrical in the front-rear direction except for, for example, a connecting portion 65 of the filling portion 60, which will be described later.

The first surface portion 20*a* bulges convexly toward the forward direction, and the second surface portion 20*b* bulges convexly toward the rearward direction. However, the first surface portion 20*a* and the second surface portion 20*b* may be approximately flat without bulging.

The container main body 20 is formed by folding the main-body forming sheet member 21 (see FIG. 8 and FIG. 9) and attaching peripheral edge portions of the main-body forming sheet member 21 to each other (in the case of the present embodiment, attaching the peripheral edge portions to each other with an inner-bag forming sheet member 41 that constitutes the inner bag 40 in between).

The container main body 20 includes a pair of edge side portions 29*a* and 29*b* that extend parallel to each other, from the gusset portion (top gusset 14) side toward the opposite side (bottom gusset 13 side). The edge side portions 29*a* and 29*b* are left and right side edge portions of the container main body 20.

Figure 3:
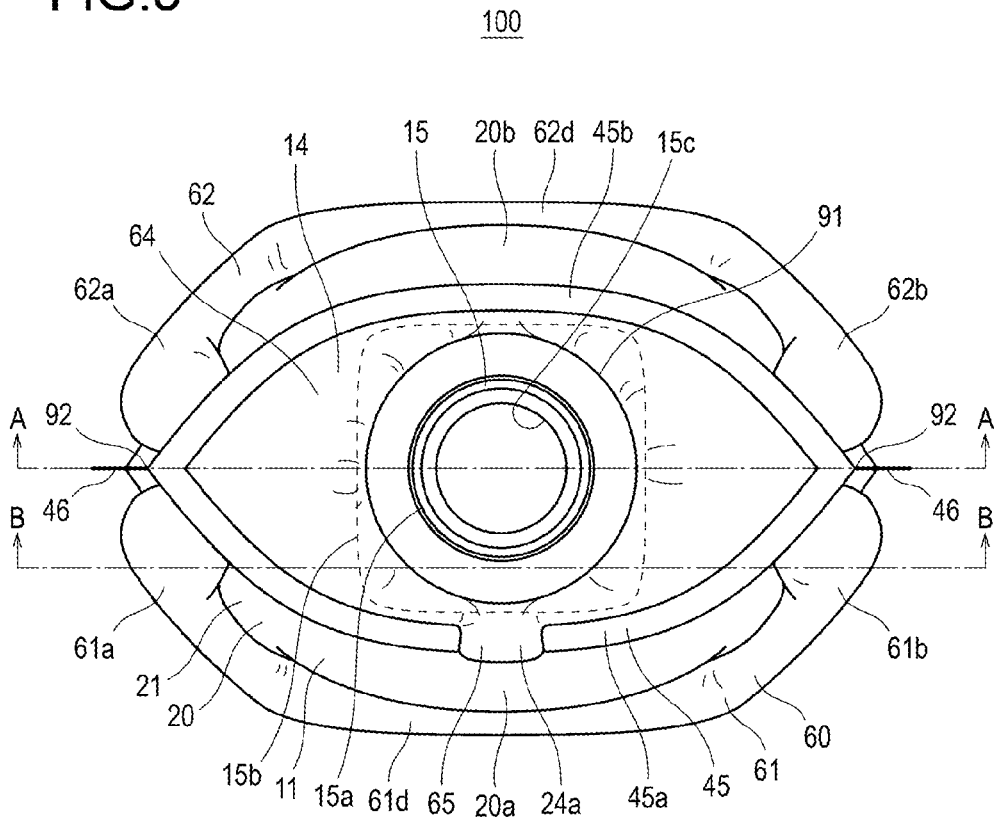
FIG. 3 shows a plane view of the container according to the embodiment, in a state in which the filler is enclosed, and a cap portion is detached.

The planar shape of the top gusset 14 is not particularly limited, but in the case of the present embodiment, the top gusset 14 is formed, as shown in FIG. 3, into such a shape that the front-rear width decreases from the central portion in the widthwise direction toward the leftward direction, and the front-rear width decreases from the central portion in the widthwise direction toward the rightward direction. The top gusset 14 is formed into, for example, a horizontally-long almond shape.

The container main body 20 includes: the gusset portion peripheral edge sealing piece 45 that is arranged along a peripheral edge of the top gusset 14; and a pair of lateral sealing pieces 46 that vertically extend along each of the left and right edge side portions 29*a* and 29*b* of the body portion 11, and include an attached portion between a peripheral edge portion of the first surface portion 20*a* and a peripheral edge portion of the second surface portion 20*b*. The gusset portion peripheral edge sealing piece 45 and the lateral sealing piece 46 stand, for example, toward the outside of the container main body 20. The dimensions of the gusset portion peripheral edge sealing piece 45 and the lateral sealing piece 46 in directions orthogonal to the extending directions of the gusset portion peripheral edge sealing piece 45 and the lateral sealing piece 46 (width sizes of the gusset portion peripheral edge sealing piece 45 and the lateral sealing piece 46) are approximately constant, for example.

The gusset portion peripheral edge sealing piece 45 surrounds the top gusset 14 in a circular shape, except for the portion, for example, in which the connecting portion 65 exists which will be described later.

The gusset portion peripheral edge sealing piece 45 includes: the first surface portion side sealing piece 45*a* that is arranged along a boundary between the gusset portion (top gusset 14) and the first surface portion 20*a*, and includes an attached portion between the peripheral edge portion of the gusset portion (top gusset 14) and a peripheral edge portion of the first surface portion 20*a*; and the second surface portion side sealing piece 45*b* that is arranged along a boundary between the gusset portion and the second surface portion 20*b*, and includes an attached portion between the peripheral edge portion of the gusset portion (top gusset 14) and the peripheral edge portion of the second surface portion 20*b*.

Figure 10:
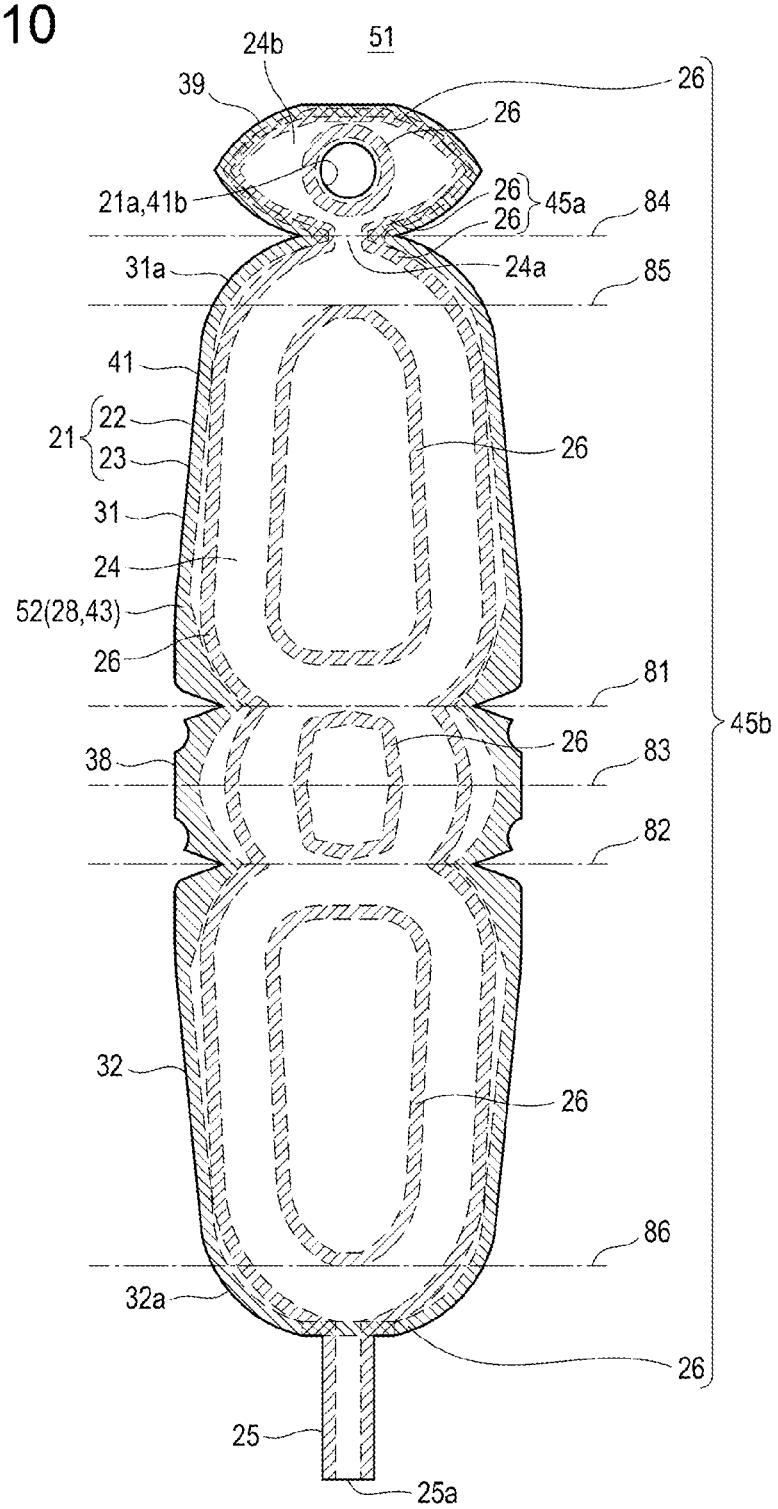
FIG. 10 shows a plane view showing a container forming sheet member having the inner-bag forming sheet member and the main-body forming sheet member which are laminated on each other.

The first surface portion side sealing piece 45*a* has a main-body sealing portion 26 that attaches an outside film layer 22 to an inside film layer 23, along an inner edge of an attached portion between the peripheral edge portion of the gusset portion and the peripheral edge portion of the first surface portion 20*a*; and the second surface portion side sealing piece 45*b* has the main-body sealing portion 26 that attaches the outside film layer 22 and the inside film layer 23, along an inner edge of an attached portion between the peripheral edge portion of the gusset portion and the peripheral edge portion of the second surface portion 20*b* (see FIG. 10). For information, in FIG. 10, for the sake of convenience, reference characters are attached to the main-body sealing portion 26 that constitutes the first surface portion side sealing piece 45*a* and the main-body sealing portion 26 that constitutes the second surface portion side sealing piece 45*b*, respectively. Here, the attached portion between the peripheral edge portion of the gusset portion and the peripheral edge portion of the first surface portion 20*a*, and the attached portion between the peripheral edge portion of the gusset portion and the peripheral edge portion of the second surface portion 20*b* are each one part of a portion in which the main-body sealing portion 28 is formed which will be described later, and are standing pieces that stand toward the outside of the container main body 20. In other words, in the case of the present embodiment, the gusset portion peripheral edge sealing piece 45 (the first surface portion side sealing piece 45*a* and the second surface portion side sealing piece 45*b*) includes: a standing piece that stands toward the outside of the container main body 20; and a main-body sealing portion 26 that is continuous with the standing piece (that is positioned more inside than the standing piece).

As shown in FIG. 3, the gusset portion filling portion 64 is arranged from the first surface portion side sealing piece 45*a* to the second surface portion side sealing piece 45*b*. In other words, the front edge of the gusset portion filling portion 64 is defined by the first surface portion side sealing piece 45*a*, and the rear edge of the gusset portion filling portion 64 is defined by the second surface portion side sealing piece 45*b*. Thereby, the outer edge of the gusset portion filling portion 64 is defined by the gusset portion peripheral edge sealing piece 45. Here, "the outer edge of the gusset portion filling portion 64 is defined" means that a length equal to or longer than 90% of the outer edge of the gusset portion filling portion 64 (a length equal to or longer than 90% of the total length of the annular outer edge) is surrounded by the gusset portion peripheral edge sealing piece 45. In the case of the present embodiment, the outer edge of the gusset portion filling portion 64 is surrounded by the gusset portion peripheral edge sealing piece 45 except for the portion in which the connecting portion 65 exists.

Because of this, the portion in which the gusset portion filling portion 64 is formed has a larger structure, accordingly the top gusset 14 can be more satisfactorily reinforced by the gusset portion filling portion 64, and the form stability of the top gusset 14 is further improved.

Figure 6A:
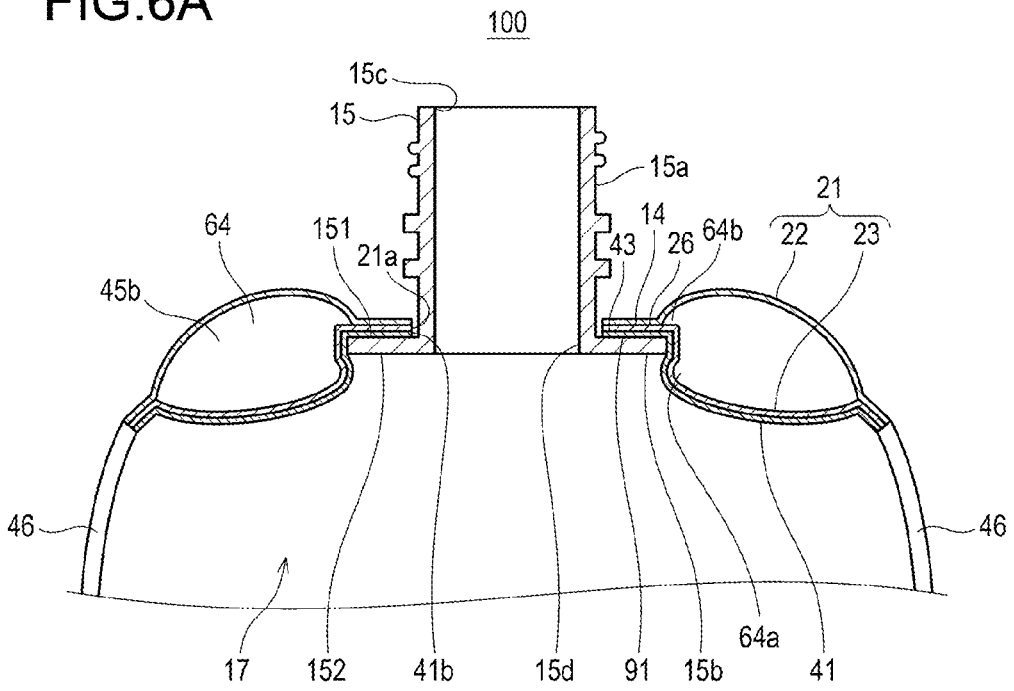
FIG. 6A shows a cross-sectional view taken along the line A-A of FIG. 3.

In addition, as shown in FIG. 3, FIG. 4, and FIG. 6A, the gusset portion filling portion 64 has an inner edge (for example, a toric inner edge) in a side close to the discharge port, and extends downward from the inner edge toward the intersection point 92 of the first surface portion side sealing piece 45*a*, the second surface portion side sealing piece 45*b*, and the lateral sealing piece 46. In this way, by the gusset portion filling portion 64 having the portion that extends downward, for example, when the container 100 is a pump container, the pumping operation can be stably performed. In addition, when the container 100 has been placed in a bathroom or the like, it is possible to prevent water or the like from accumulating in the gusset portion.

More specifically, in the gusset portion filling portion 64, each of portions heading for the left and right sides extend downward toward the intersection point 92 from the toric inner edge. As an example, as shown in FIG. 6A, the shape of the upper edge of the gusset portion filling portion 64 in front surface view (or back surface view) has an arc-like curved (bulging) shape, and the center position of the gusset portion filling portion 64 extends downward toward the intersection point 92. More specifically, in the gusset portion filling portion 64, a portion that is positioned on the right side of the discharge port (on viewer's right side) has a curved shape that bulges convexly toward the upper right, and a portion that is positioned on the left side of the discharge port (on viewer's left side) has a curved shape that bulges convexly toward the upper left.

Figure 7:
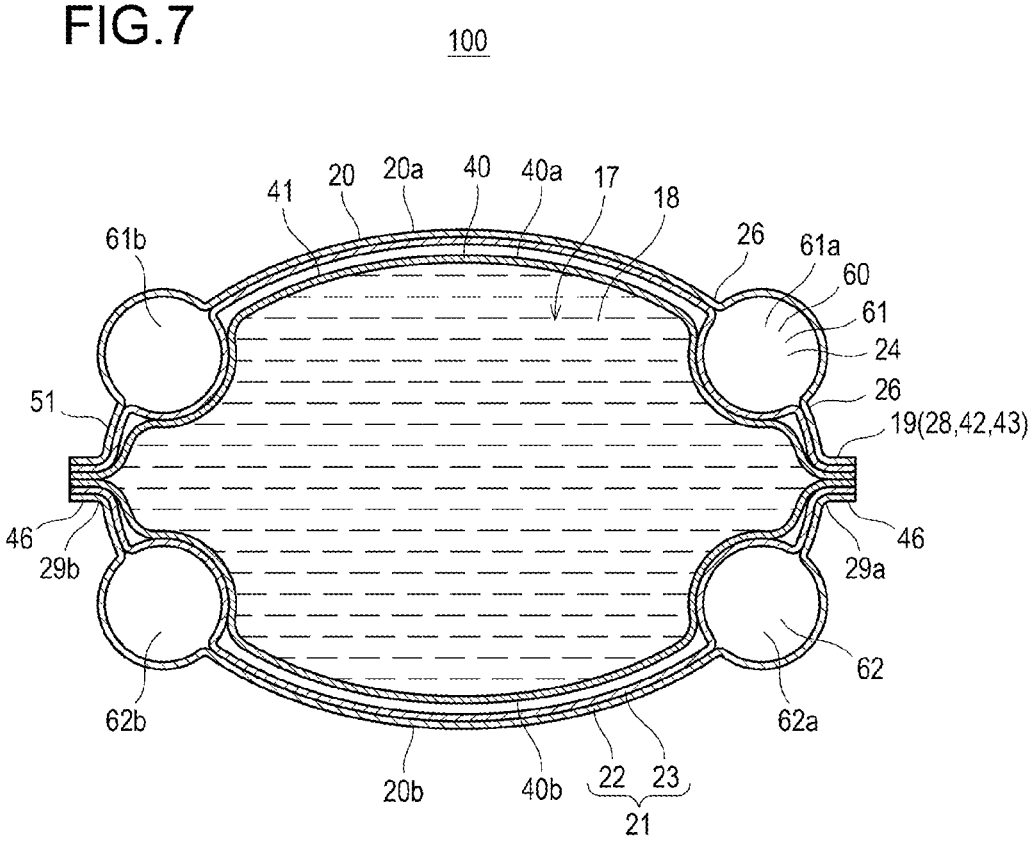
FIG. 7 shows a cross-sectional view taken along the line A-A of FIG. 2.

In the case of the present embodiment, the inner bag 40 is structured by attaching one parts in the peripheral edge portion of the inner-bag forming sheet member 41 (see FIG. 9) to each other (see FIG. 7). In other words, the inner bag 40 having a bag shape is structured by folding the inner-bag forming sheet member 41 and attaching the peripheral edge portions of the inner-bag forming sheet member 41 to each other. The inner bag 40 is covered with the container main body 20. The inner bag 40 has the containing portion 17 in an inside of the inner bag 40.

However, in the present invention, in the case where an inner container that defines the containing portion 17 is arranged in an inside of the container main body 20, the inner container is not limited to the inner bag 40 formed of the sheet member, and may be formed by blow molding, for example.

A shape of the inner bag 40 is not particularly limited, but in the case of the present embodiment, the inner bag 40 is formed in a similar shape to that of the container main body 20.

As shown in FIG. 7, the inner bag 40 has a first principal plane portion 40*a* that is positioned on the front surface side and a second principal plane portion 40*b* that is positioned on the back surface side, with the containing portion 17 being arranged therebetween.

The container 100 includes, for example, a spout member 15 that is provided so as to penetrate the top gusset 14, and a cap portion 70 that is attached (for example, detachably attached) to the spout member 15. In other words, the cap portion 70 is attached to a discharge portion (for example, the spout member 15) having the discharge port.

More specifically, for example, as shown in FIG. 2, the spout member 15 includes a pouring cylindrical portion 15*a* through which the contents 18 passes, and a plate portion 15*b* of a plate shape, which is provided at one end (lower end) in an axial direction of the pouring cylindrical portion 15*a* so as to be orthogonal to the axial direction, which are provided in an integral manner. A screw thread is formed on an outer peripheral surface of the pouring cylindrical portion 15*a*, and the pouring cylindrical portion 15*a* has a male screw shape. The pouring cylindrical portion 15*a* vertically penetrates the top gusset 14 and protrudes upward from the top gusset 14.

The plate portion 15*b* juts out from the lower end of the pouring cylindrical portion 15*a* toward the periphery, in a flange shape. The planar shape of the plate portion 15*b* is not particularly limited, but may be, for example, an approximately square shape (FIG. 3).

Figure 6B:
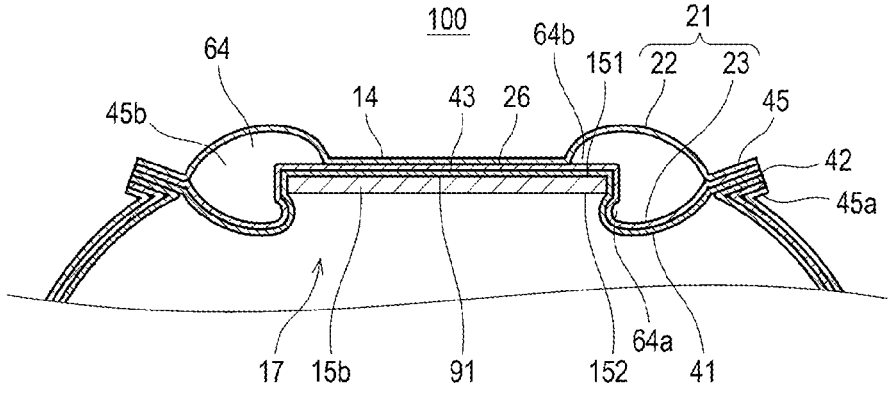
FIG. 6B is a cross-sectional view taken along the line B-B of FIG. 3.

The plate portion 15*b* is provided, for example, on an inner surface or an external surface of a portion which is arranged along the top gusset 14 of the body portion 11, in the inner-bag forming sheet member 41. For example, as illustrated in FIG. 6A and FIG. 6B, the plate portion 15*b* is attached to an inner surface 152 (lower surface) of the inner-bag forming sheet member 41 at an attached portion 91, in the top gusset 14. Because of this, the plate portion 15*b* is indirectly attached to the main-body forming sheet member 21 with the inner-bag forming sheet member 41 in between. However, the present invention is not limited to this example, and the plate portion 15*b* may be directly attached to the inside film layer 23 of the main-body forming sheet member 21. In plane view, the attached portion 91 surrounds the periphery of the pouring cylindrical portion 15*a*, in a circular shape. The attached portion 91 defines an inner edge of the gusset portion filling portion 64. A portion in which the attached portion 91 is formed is contained, for example, more inside than an external line of the plate portion 15*b* in plane view. More specifically, the attached portion 91 is formed, for example, in the same range as the toric main-body sealing portion 26 (see FIG. 10) that is positioned on a periphery of the insertion hole 21*a*.

An opening 15*c* of the top end of the pouring cylindrical portion 15*a* is the discharge port that discharges the contents 18 from the containing portion 17. An opening 15*d* is formed in the plate portion 15*b* coaxially with the inner space of the pouring cylindrical portion 15*a*. The contents 18 in the containing portion 17 is discharged to the outside through the openings 15*d* and 15*c*.

In this way, the container 100 has the plate portion 15*b* that is attached to the main-body forming sheet member 21, and the discharge port (opening 15*c*) is structured to discharge the contents 18 through the opening 15*d* in the center of the plate portion 15*b*.

In addition, an external surface 151 (top surface) of the plate portion 15*b* is directly attached to the innermost layer of the main-body forming sheet member 21 (in the case of the present embodiment, inside film layer 23), or is indirectly attached thereto with another sheet member in between (in the case of the present embodiment, the inner-bag forming sheet member 41).

Thereby, as shown in FIG. 6A and FIG. 6B, in a state in which the filler is enclosed in the gusset portion filling portion 64, the main-body forming sheet member 21 is folded from the external surface 151 of the plate portion 15*b* along the end surface of the plate portion 15*b*, and is arranged so as to head further downward beyond the plate portion 15*b*. Therefore, the main-body forming sheet member 21 holds the plate portion 15*b* and consequently the spout member 15 from periphery (regulates the horizontal movement of the spout member 15), and accordingly improves the stability of the spout member 15 in the horizontal direction.

In addition, the container 100 has the attached portion 91 that directly attaches the plate portion 15*b* to the main-body forming sheet member 21, or indirectly attaches the plate portion 15*b* with another sheet member in between; and an inner edge of the gusset portion filling portion 64 is arranged along the outer edge of the attached portion 91. In other words, the inner edge of the gusset portion filling portion 64 is defined by the attached portion 91.

Also, by the structure, the stability of the spout member 15 in the horizontal direction is improved.

In the case of the present embodiment, the planar shape of the attached portion 91 becomes a toric shape. Because of this, the outer edge of the attached portion 91 includes a curved portion that is convex outward.

As a result, tilting of the spout member 15 is suppressed as compared with the case where the outer edge of the attached portion 91 is formed only by a straight line.

The portion in which the attached portion 91 is formed is contained more inside than an outer edge of the plate portion 15*b*. Because of this, as shown in FIG. 6A and FIG. 6B, one part 64*b* of the gusset portion filling portion 64 covers the external surface 151 (upper surface) of the plate portion 15*b*.

Thereby, the plate portion 15*b* results in being pressed by the gusset portion filling portion 64 from the upper side, and accordingly, it is suppressed that the plate portion 15*b* and consequently the spout member 15 are displaced upward.

Furthermore, another part 64*a* of the gusset portion filling portion 64 covers, for example, an inner surface 152 (lower surface) of the plate portion 15*b*.

Thereby, the plate portion 15*b* results in being supported by the gusset portion filling portion 64 from the lower side, and accordingly, it is suppressed that the plate portion 15*b* and consequently the spout member 15 are displaced to the lower side. Therefore, it becomes possible to perform the pumping operation more stably.

The cap portion 70 includes: for example, an attachment portion 71 that is a cylindrical portion having a female screw shape and is detachably screwed to the pouring cylindrical portion 15*a*; a pump portion 72 that is fixed to the attachment portion 71; a dip tube 77 that extends downward from the pump portion 72; and a head portion 73 that is held by the pump portion 72 so as to be movable up and down with respect to the pump portion 72.

The head portion 73 includes, for example, a support cylindrical portion 74 that projects upward from the pump portion 72, and a nozzle portion 75 that projects horizontally from an upper end portion of the head portion 73; and a discharge port 76 that discharges the contents 18 is formed at the top end of the nozzle portion 75.

A flow path (not shown in the drawings) of the contents 18 in the cap portion 70 is arranged so as to vertically penetrate the opening 15*d* and the opening 15*c*.

The head portion 73 is structured so that when the head portion 73 is pushed in (pushed down) against the pump portion 72, the contents 18 is discharged from the discharge port 76 by an action of the pump portion 72. The pressing operation of the head portion 73 is referred to as the pumping operation.

In the case of the present embodiment, as shown in FIG. 1 to FIG. 5, the filling portion 60 includes, for example: a first filling portion 61 that is formed in a circular shape along the peripheral edge portion of the first surface portion 20*a*; a second filling portion 62 that is formed in a circular shape along a peripheral edge portion of the second surface portion 20*b*; a third filling portion 63 (FIG. 5), which is formed in a circular shape along a peripheral edge portion of the bottom gusset 13; and the gusset portion filling portion 64 that is formed in a circular shape in a periphery of the pouring cylindrical portion 15*a* in the top gusset 14.

A lower edge of the first filling portion 61 is connected to a front edge of the third filling portion 63; a lower edge of the second filling portion 62 is connected to a back edge of the third filling portion 63; and the central portion in the widthwise direction of the upper end portion of the first filling portion 61 is connected to the central portion in the widthwise direction of the front-end portion of the gusset portion filling portion 64.

The container 100 includes the filling portion 60 of such a structure, and thereby a sufficient structural strength is ensured almost over the whole container main body 20.

Figure 9:
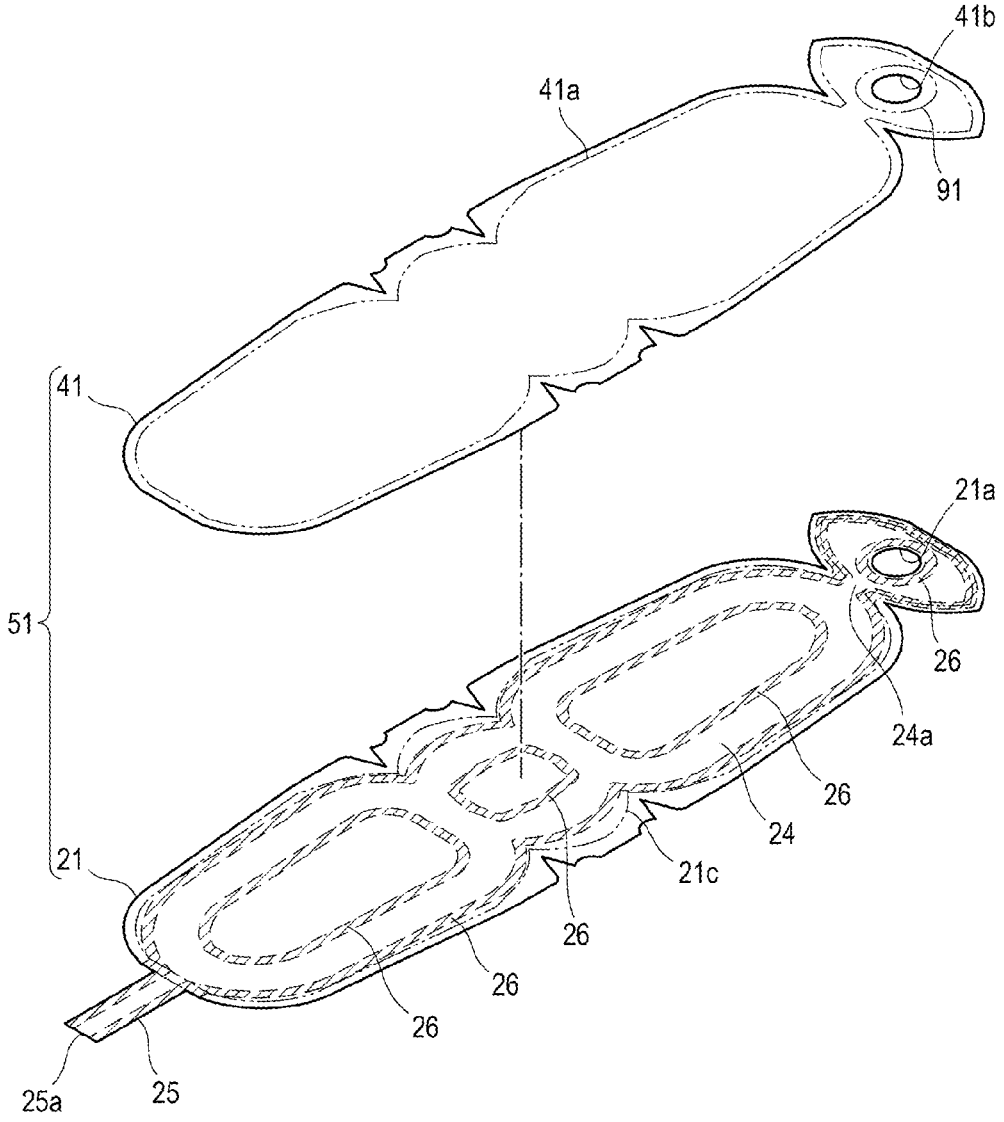
FIG. 9 shows an exploded perspective view showing an inner-bag forming sheet member and a main-body forming sheet member.

In the case of the present embodiment, the whole of the filling portion 60 is formed in an integrated manner. Here, the connecting portion 65 between the first filling portion 61 and the gusset portion filling portion 64 is narrow. In other words, a connecting portion 24*a* which is a portion to become the connecting portion 65 in the non-attached region 24 is narrow (FIG. 9 and FIG. 10).

In addition, in the present invention, the container 100 may include a plurality of filling portions 60 that are independent from each other.

More specifically, the first filling portion 61 includes, for example: a first edge side filling portion 61*a* that extends vertically along the edge side portion 29*a*; a first edge side filling portion 61*b* that extends vertically along the edge side portion 29*b*; a first adjacent filling portion 61*c* that connects an upper end of the first edge side filling portion 61*a* and an upper end of the first edge side filling portion 61*b* to each other; and a first lower edge filling portion 61*d* that connects a lower end of the first edge side filling portion 61*a* and a lower end of the first edge side filling portion 61*b* to each other.

The first adjacent filling portion 61*c* is arranged at an upper end portion of the first surface portion 20*a*, and extends, for example, in an arc shape that is convex upward.

The first lower edge filling portion 61*d* is arranged at a lower end portion of the first surface portion 20*a*, and extends approximately horizontally in the left and right directions, for example.

Similarly, the second filling portion 62 includes, for example: a second edge side filling portion 62*a* that extends vertically along the edge side portion 29*a*; a second edge side filling portion 62*b* that extends vertically along the edge side portion 29*b*; a second adjacent filling portion 62*c* that connects an upper end of the second edge side filling portion 62*a* and an upper end of the second edge side filling portion 62*b* to each other; and a second lower edge filling portion 62*d* that connects a lower end of the second edge side filling portion 62*a* and a lower end of the second edge side filling portion 62*b* to each other.

The second adjacent filling portion 62*c* is arranged at an upper end portion of the second surface portion 20*b*, and extends, for example, in an arc shape that is convex upward.

The second lower edge filling portion 62*d* is arranged at a lower end portion of the second surface portion 20*b*, and extends approximately horizontally in the left and right directions, for example.

In this way, the first adjacent filling portion 61*c* connects the respective upper ends of the pair of first edge side filling portions 61*a* and 61*b*, and the second adjacent filling portion 62*c* connects the respective upper ends of the pair of second edge side filling portions 62*a* and 62*b*.

As shown in FIG. 4, an upper end 611 of the first edge side filling portion 61*b* is arranged in the vicinity of one part of the gusset portion filling portion 64. A distance between the upper end 611 of the first edge side filling portion 61*b* and the gusset portion filling portion 64 is preferably smaller than a thickness D1 of the first edge side filling portion 61*b* in the upper end 611. For example, a height position of the upper end 611 of the first edge side filling portion 61*b* becomes the same height position as the height position of the intersection point 92 between the gusset portion peripheral edge sealing piece 45 and the upper end of the lateral sealing piece 46.

Similarly, an upper end 621 of the second edge side filling portion 62*b* is arranged in the vicinity of another part of the gusset portion filling portion 64. A distance between the upper end 621 of the second edge side filling portion 62*b* and the gusset portion filling portion 64 is preferably smaller than a thickness D2 of the first edge side filling portion 61*b* in the upper end 621. For example, a height position of the upper end 621 of the second edge side filling portion 62*b* becomes the same height position as the height position of the intersection point 92 between the gusset portion peripheral edge sealing piece 45 and the upper end of the lateral sealing piece 46.

Similarly, each of the upper end of the first edge side filling portion 61*a* and the upper end of the second edge side filling portion 62*a* is arranged in the vicinity of a further another part of the gusset portion filling portion 64, and is pressed against the gusset portion filling portion 64.

In this way, the container main body 20 includes the pair of edge side portions 29*a* and 29*b* that extend from the gusset portion (top gusset 14) side toward the opposite side (bottom gusset 13 side), in parallel with each other; and the filling portion 60 includes the pair of first edge side filling portions 61*a* and 61*b* that are formed in the first surface portion 20*a* along the pair of edge side portions 29*a* and 29*b*, respectively, and the pair of second edge side filling portions 62*a* and 62*b* that are formed in the second surface portion 20*b* along the pair of edge side portions 29*a* and 29*b*, respectively.

In addition, one parts of the gusset portion filling portion 64 are arranged in the vicinity of each of the pair of first edge side filling portions 61*a* and 61*b* and in the vicinity of each of the pair of second edge side filling portions 62*a* and 62*b*, respectively.

Thereby, the gusset portion filling portion 64 results in being satisfactorily supported by the first edge side filling portions 61*a* and 61*b* and the second edge side filling portions 62*a* and 62*b*, and accordingly, the form stability of the gusset portion filling portion 64 is further improved.

More preferably, the upper end 611 of the first edge side filling portion 61*b* and the gusset portion filling portion 64 press each other (with one part of the inner bag 40 being arranged therebetween), in an inside of the container main body 20. Similarly, the upper end of the first edge side filling portion 61*a* and the gusset portion filling portion 64 press each other in an inside of the container main body 20.

In addition, the upper end 621 of the second edge side filling portion 62*b* and the gusset portion filling portion 64 press each other (with one part of the inner bag 40 being arranged therebetween), in an inside of the container main body 20. Similarly, the upper end of the second edge side filling portion 62*a* and the gusset portion filling portion 64 press each other in an inside of the container main body 20.

Thereby, the gusset portion filling portion 64 is further satisfactorily supported by the first edge side filling portions 61*a* and 61*b* and the second edge side filling portions 62*a* and 62*b*, and the form stability of the gusset portion filling portion 64 is further improved.

In addition, the first adjacent filling portion 61*c* extends along the first surface portion side sealing piece 45*a*. Similarly, the second adjacent filling portion 62*c* extends along the second surface portion side sealing piece 45*b*.

In other words, the filling portion 60 includes: the first adjacent filling portion 61*c* that is formed in the first surface portion 20*a* along the first surface portion side sealing piece 45*a*; and a second adjacent filling portion 62*c* that is formed in the second surface portion 20*b* along the second surface portion side sealing piece 45*b*.

Thereby, the gusset portion filling portion 64 results in being satisfactorily supported by the first adjacent filling portion 61*c* and the second adjacent filling portion 62*c*, and accordingly, the form stability of the gusset portion filling portion 64 is further improved.

More preferably, the first adjacent filling portion 61*c* and the gusset portion filling portion 64 press each other (with one part of the inner bag 40 being arranged therebetween), in an inside of the container main body 20. Similarly, the second adjacent filling portion 62*c* and the gusset portion filling portion 64 press each other (with one part of the inner bag 40 being arranged therebetween), in an inside of the container main body 20.

Thereby, the gusset portion filling portion 64 is further satisfactorily supported by the first adjacent filling portion 61*c* and the second adjacent filling portion 62*c*, and the form stability of the gusset portion filling portion 64 is further improved.

Figure 8:
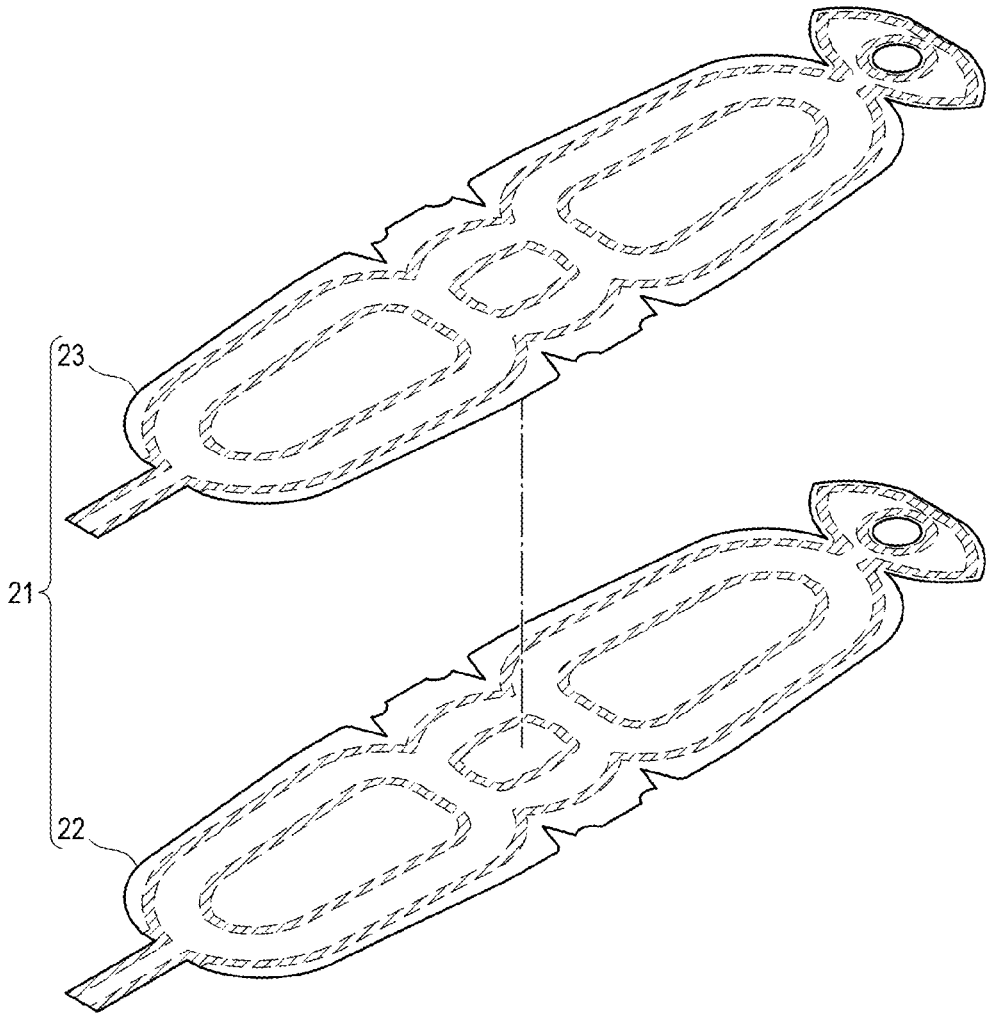
FIG. 8 shows an exploded perspective view showing an inside film layer and an outside film layer of the main-body forming sheet member.

As shown in FIG. 8 and FIG. 9, the main-body forming sheet member 21 is formed by laminating and attaching the outside film layer 22 that constitutes an external surface side of the container main body 20 and the inside film layer 23 that constitutes an inner surface side of the container main body 20 to each other. In other words, in the case of the present embodiment, the main-body forming sheet member 21 is formed of two film layers of the outside film layer 22 and the inside film layer 23, as an example. However, the present invention is not limited to this example, and the main-body forming sheet member 21 may have a film layer other than the outside film layer 22 and the inside film layer 23.

In the case of the present embodiment, the outside film layer 22 and the inside film layer 23 are formed to be the same shape as each other. However, the present invention is not limited to this example, and the outside film layer 22 and the inside film layer 23 may have different shapes from each other. In the case of the different shapes, the shape of the outside film layer 22 is preferably larger than that of the inside film layer 23.

In each of the outside film layer 22 and the inside film layer 23, an insertion hole is formed through which the pouring cylindrical portion 15*a* of the spout member 15 is inserted.

In the main-body forming sheet member 21, a non-attached region 24 (FIG. 9) is formed in which the outside film layer 22 and the inside film layer 23 are partially non-attached. For example, in one or both of the outside film layer 22 and the inside film layer 23, a surface facing the other one is partially subjected to non-attaching treatment. The non-attaching treatment can be easily performed through application of a non-attaching agent (so-called adhesion inhibiting agent) into an adhesion inhibiting state. As the adhesion inhibiting agent, any agent can be used as long as the agent can suppress the attaching between the outside film layer 22 and the inside film layer 23. As the adhesion inhibiting agent, for example, printing inks, medium inks, inks dedicated to the adhesion inhibiting agent and the like which are used for offset printing, flexography, and letterpress printing (relief printing), respectively, can be preferably used. In addition, a thermosetting type or UV curable type of ink can be preferably used. The area which has been subjected to the non-attaching treatment becomes the non-attached region 24. The filling portion 60 in which the filler is enclosed is configured to be formed by the filler being enclosed in the non-attached region 24.

The filler may be a fluid (gas or liquid), a solid (for example, a powder-granular material, resin pellets or the like), or a semisolid (for example, a foaming agent or the like); and is preferably a gas such as air.

The filling portion 60 is not necessarily formed in the entire non-attached region 24, and may be formed in a part of a plurality of non-attached regions 24.

In FIG. 8, a hatch pattern upward to the right is attached to each portion, for the sake of convenience, in which the outside film layer 22 and the inside film layer 23 are attached to each other and become the main-body sealing portion 26.

In FIG. 9 and FIG. 10, a hatch pattern upward to the right is attached to a portion in which the outside film layer 22 and the inside film layer 23 are attached to each other in the main-body forming sheet member 21, so as to define the non-attached region 24, that is, to a portion in which the main-body sealing portion 26 is formed, for the sake of convenience.

Furthermore, in FIG. 9, a seal boundary line 21*c* that is a boundary line between a sealing portion of the peripheral edge portion of the main-body forming sheet member 21 and the other portion is shown by a two dot chained line. In the case of the present embodiment, in a portion in an outside of the seal boundary line 21*c* of the main-body forming sheet member 21, when the bag is formed, the outside film layer 22 and the inside film layer 23 are attached to each other, and the inside film layer 23 and the inner-bag forming sheet member 41 are also attached to each other.

As a method of attaching the outside film layer 22 and the inside film layer 23, as an example, heat sealing, ultrasonic sealing, attaching with an adhesive, or the like can be used.

In the case of the present embodiment, each of the outside film layer 22 and the inside film layer 23 has a layer structure including a plurality of resin layers. In addition, the inner-bag forming sheet member 41 also has a layer structure including a plurality of resin layers.

The main-body forming sheet member 21 preferably includes any one of polyethylene-based, polypropylene-based, polyester-based and polyamide-based resin layers.

A material of the resin layer that constitutes the outside film layer 22 and the inside film layer 23 of the main-body forming sheet member 21 is not particularly limited, but is more preferably any one of, for example, a polyethylene-based material such as high-density polyethylene (HDPE), medium-density polyethylene (MDPE), low-density polyethylene (LDPE), linear low-density polyethylene (LLDPE), ultra-low-density polyethylene (ULDPE), and an ethylene-vinyl alcohol copolymer (EVOH), a polypropylene-based material such as oriented polypropylene (OPP), non-oriented polypropylene (CPP), isotactic PP, syndiotactic PP, atactic PP, random PP and block PP, a polyester-based material such as polyethylene terephthalate (PET), amorphous polyethylene terephthalate (amorphous PET), polybutylene terephthalate (PBT), polyethylene naphthalate (PEN) and polybutylene naphthalate (PBN), and a polyamide-based material such as oriented nylon (ONy), unoriented nylon (CNy), nylon 6, nylon 66, nylon 11, nylon 12 and MXD6. Among these, the above polyethylene-based material is particularly preferable.

The outside film layer 22 has, as an example, a four-layer structure that is formed by laminating four resin layers of a first layer, a second layer, a third layer and a fourth layer, in this order.

Among these, the first layer constitutes the external surface of the container main body 20. The first layer is formed from, for example, polyethylene terephthalate (PET) or oriented nylon (ONy). Main functions of the first layer include providing a feeling of gloss and printability to the container main body 20 and ensuring a rigidity of the container main body 20.

The second layer is, for example, a transparent vapor-deposited PET layer formed from polyethylene terephthalate, and on the surface on the first layer side of the second layer, silica and/or alumina is vapor-deposited. Main functions of the second layer include providing gas barrier properties to the container main body 20.

The third layer is formed from, for example, oriented nylon. Main functions of the third layer include ensuring a pinhole resistance of the container main body 20.

The fourth layer is formed from, for example, linear low-density polyethylene (LLDPE). Main functions of the fourth layer include ensuring a heat seal property with the inside film layer 23.

Examples of the layer structure of the inside film layer 23 include a layer structure having a fifth layer formed from, for example, linear low-density polyethylene (LLDPE), in addition to the layer structure similar to the first layer to the fourth layer in the outside film layer 22. The fifth layer is a layer adjacent to the first layer, and constitutes a surface opposite to the fourth layer in the inside film layer 23. Main functions of the fifth layer include ensuring the heat seal property with the outside film layer 22.

Main functions of the fourth layer of the inside film layer 23 include ensuring heat seal property with the inner-bag forming sheet member 41.

However, the layer structures of the outside film layer 22 and the inside film layer 23 are not limited to the above examples, and the material of each layer constituting the outside film layer 22 and the inside film layer 23 is not limited to the above examples.

The inner-bag forming sheet member 41 that constitutes the inner bag 40 has a three-layer structure as an example, which is configured by laminating a first layer, a second layer and a third layer, in this order.

Among these, the first layer is formed from, for example, linear low-density polyethylene. Main functions of the first layer include ensuring a heat seal property with the main-body forming sheet member 21 (heat seal property with inside film layer 23).

The second layer is, for example, a transparent deposition oriented nylon layer formed from oriented nylon, and on the surface on the first layer side of the second layer, silica and/or alumina is vapor-deposited. Main functions of the second layer include ensuring gas barrier properties and pinhole resistance.

The third layer is formed from, for example, linear low-density polyethylene. Main functions of the third layer include ensuring a heat seal property between each other of the inner-bag forming sheet members 41.

Note that the layer structure of the inner-bag forming sheet member 41 is not limited to the structure described here.

As shown in FIG. 9 and FIG. 10, the inner-bag forming sheet member 41 is laminated on the main-body forming sheet member 21; and as shown in FIG. 10, the peripheral edge portion of the inside film layer 23 and the peripheral edge portion of the inner-bag forming sheet member 41 are attached to each other, and the peripheral edge portions of the outside film layer 22 and the peripheral edge portions of the inside film layer 23 are also attached to each other. Thereby, a container forming sheet member 51 is formed by the main-body forming sheet member 21 and the inner-bag forming sheet member 41.

Here, the sealing portion of the peripheral edge portion of the container forming sheet member 51 is referred to as a peripheral edge sealing portion 52. The peripheral edge sealing portion 52 includes: a sealing portion between the peripheral edge portion of the inside film layer 23 and the peripheral edge portion of the inner-bag forming sheet member 41 (hereinafter referred to as inner/outer sealing portion 43); and a sealing portion between the peripheral edge portion of the outside film layer 22 and the peripheral edge portion of the inside film layer 23 (hereinafter referred to as main-body sealing portion 28). The gusset portion peripheral edge sealing piece 45 is formed in one part of the portion in which the main-body sealing portion 28 is formed, and the lateral sealing piece 46 is formed in another part. For information, the main-body sealing portion 28 may also function as a sealing portion that defines an outer peripheral side of the non-attached region 24, and in the portion in which the main-body sealing portion 28 defines the outer peripheral side of the non-attached region 24, the main-body sealing portion 26 which is positioned more inside than the standing piece and does not stand may not exist on the outer peripheral side of the non-attached region 24.

In FIG. 10, a hatch pattern upward to the left is attached to a portion in which the peripheral edge sealing portion 52 is formed. In addition, in FIG. 10, the hatch pattern upward to the left and the hatch pattern upward to the right overlap each other, in a portion where a portion in which the peripheral edge sealing portion 52 is formed and a portion in which the main-body sealing portion 26 is formed overlap each other.

As a method of forming the peripheral edge sealing portion 52, as an example, heat sealing, ultrasonic sealing, attaching with an adhesive, or the like can be used.

As shown in FIG. 10, the main-body forming sheet member 21 includes, for example: a first sheet portion 31 that is a part constituting the first surface portion 20*a*; a second sheet portion 32 that is a part constituting the second surface portion 20*b*; a bottom gusset forming sheet portion 38 that is a part constituting the bottom gusset 13; a top gusset forming sheet portion 39 that is a part constituting the top gusset 14; and a tube-shaped extending portion 25. The extending portion 25 extends outward from the second sheet portion 32, for example.

In the top gusset forming sheet portion 39, an insertion hole 21*a* is formed through which the pouring cylindrical portion 15*a* of the spout member 15 is inserted.

In the present embodiment, the non-attached region 24 is formed into a shape corresponding to the shape of the filling portion 60 of the container 100.

In the non-attached region 24, a portion 24*b* that becomes the gusset portion filling portion 64 is formed into such a circular shape as to surround the insertion hole 21*a* as shown in FIG. 10, for example. More specifically, an outer edge (external line) of the portion 24*b* has a shape slightly smaller than an external line of the top gusset forming sheet portion 39, and the inner edge of the portion 24*b* has a circular shape slightly larger than the insertion hole 21*a*, for example.

In the case of the present embodiment, the inner-bag forming sheet member 41 is formed in the same shape as the portion of the main-body forming sheet member 21 excluding the extending portion 25.

Note that in FIG. 9, a seal boundary line 41*a* of the inner-bag forming sheet member 41 is shown by a two-dot chained line for the sake of convenience. The seal boundary line 41*a* is a boundary line between a portion in which the inner-bag forming sheet member 41 is attached (sealed) to the main-body forming sheet member 21 and another portion in the inner-bag forming sheet member 41, and also is a boundary line between a portion in which the inner-bag forming sheet members 41 are attached to each other when the container 100 is formed with the use of the container forming sheet member 51, and another portion in the inner-bag forming sheet member 41.

In the case of the present embodiment, a position of the seal boundary line 41*a* and a position of the seal boundary line 21*c* correspond to each other (overlap each other).

An insertion hole 41*b* through which the pouring cylindrical portion 15*a* of the spout member 15 is inserted is formed in a part of the inner-bag forming sheet member 41 in which the inner-bag forming sheet member 41 overlaps with the top gusset forming sheet portion 39.

The plate portion 15*b* of the spout member 15 is attached to, for example, an inner surface of a part of the inner-bag forming sheet member 41, in which the inner-bag forming sheet member 41 overlaps with the top gusset forming sheet portion 39. The pouring cylindrical portion 15*a* passes through the insertion hole 41*b* of the inner-bag forming sheet member 41 and the insertion hole 21*a* of the top gusset forming sheet portion 39, and projects to the external surface side of these sheets.

The peripheral edge portions (peripheral edge sealing portions 52) of the container forming sheet member 51 are attached to each other (inner-bag forming sheet members 41 together) in a state in which the container forming sheet member 51 is valley-folded in each of a folding line 81, a folding line 82 and a folding line 84 shown in FIG. 10, and also is mountain-folded in each of a folding line 83 and a folding line 85; and thereby the container forming sheet member 51 is formed into a double-structured bag shape. Here, "valley fold" refers to a way of folding the sheet member so as to become convex toward the back side in FIG. 10, and "mountain fold" refers to a way of folding the sheet member so as to become convex toward the front side in FIG. 10.

In other words, the edge portions of the inner-bag forming sheet member 41 are attached to each other, and the inner bag sealing portion 42 (see FIG. 1) is formed; and thereby the inner bag 40 is formed by the inner-bag forming sheet member 41, and the bag-shaped container main body 20 is formed which covers the inner bag 40.

As a method of attaching the inner-bag forming sheet members 41 to each other, as an example, heat sealing, ultrasonic sealing, attaching with an adhesive, or the like can be used.

In the case of the present embodiment, the main-body sealing portion 28, the inner bag sealing portion 42, and the inner/outer sealing portion 43 are arranged at positions that correspond to each other (positions that overlap each other). The main-body sealing portion 28, the inner bag sealing portion 42, and the inner/outer sealing portion 43 are collectively referred to as a peripheral edge sealing portion 19 (where the peripheral edge sealing portion 19 includes the main-body sealing portion 28, the inner bag sealing portion 42, and the inner/outer sealing portion 43).

Because of this, in the case of the present embodiment, each of the gusset portion peripheral edge sealing piece 45 and the lateral sealing piece 46 includes the main-body sealing portion 28, the inner bag sealing portion 42, and the inner/outer sealing portions 43.

However, the present invention is not limited to this example, and the gusset portion peripheral edge sealing piece 45 and the lateral sealing piece 46 may be composed of only the main-body sealing portion 28.

In the first sheet portion 31, a portion closer to the top gusset forming sheet portion 39 than the folding line 85 is a first overlapping portion 31*a*. In a state before the non-attached region 24 is filled with the filler, the first overlapping portion 31*a* is arranged so as to overlap with one half part of the top gusset forming sheet portion 39.

In the second sheet portion 32, a portion positioned farther from the bottom gusset forming sheet portion 38 than the folding line 86 is a second overlapping portion 32*a*. In a state before the non-attached region 24 is filled with the filler, the second overlapping portion 32*a* is arranged so as to overlap with the other half part of the top gusset forming sheet portion 39.

Figure 11:
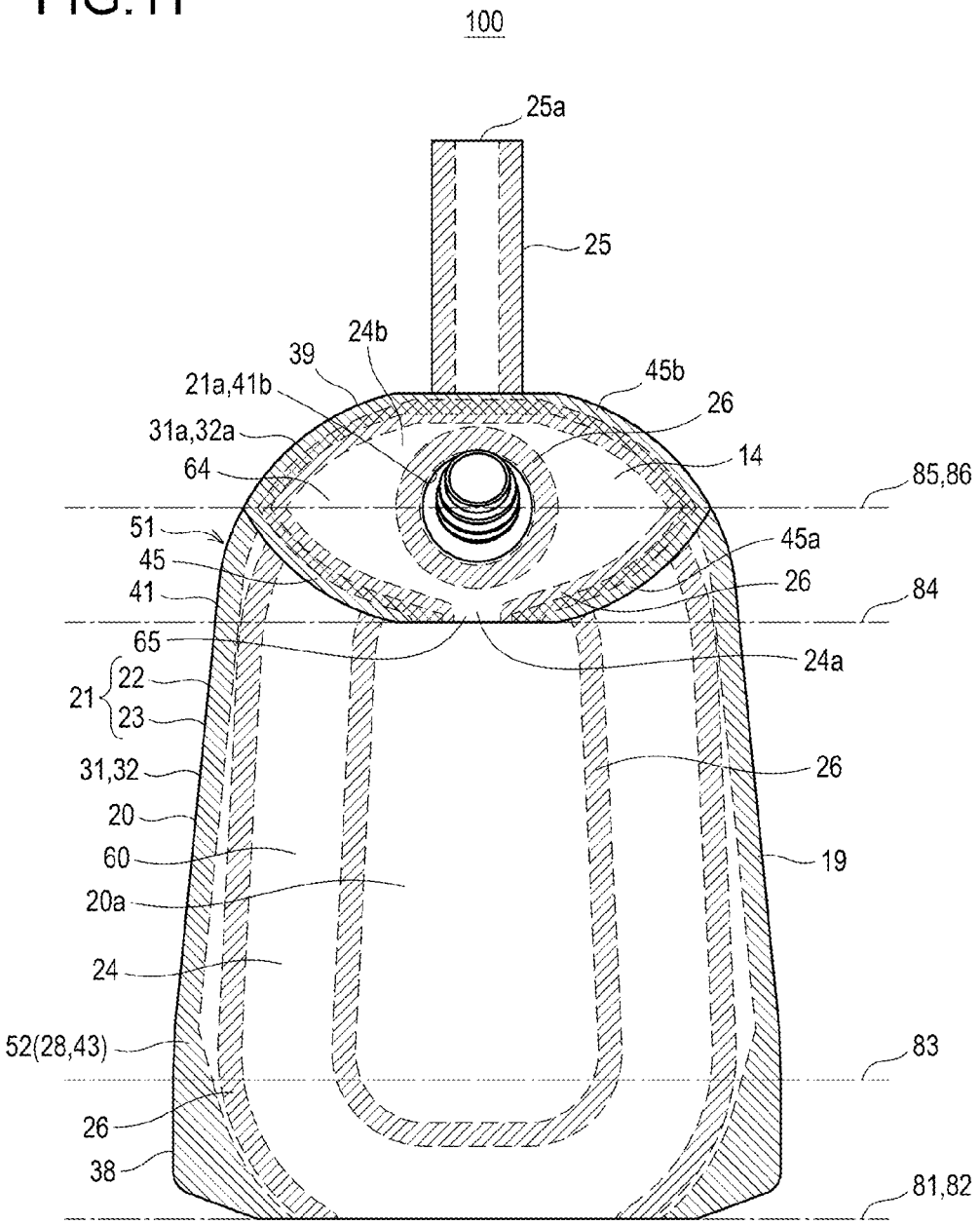
FIG. 11 is a plane view of the container according to the embodiment, in a state before the filler is enclosed.

In this way, as shown in FIG. 11, the container forming sheet member 51 is formed into the double bag shape, and the container 100 is obtained. In the container 100, a filler is injected into the non-attached region 24, for example, from an injection port 25*a* (FIG. 10) which is formed in the extending portion 25, and then the non-attached region 24 is sealed at a portion that is connected to the base end side of the extending portion 25. Thereby, the filler is enclosed in the non-attached region 24 (filling portion 60).

For information, a pressure in an inside of the filling portion 60 is not particularly limited, but is preferably higher than the atmospheric pressure, and can be, for example, set at a pressure equal to or higher than 10 kPa and equal to or lower than 500 kPa (gauge pressure).

In other words, the filling portion in which the filler can be enclosed refers to a space that is positioned between the layers of the outside film layer 22 and the inside film layer 23, and can keep a sealing property when the filler has been enclosed at a pressure of about equal to or higher than 10 kPa and equal to or lower than 500 kPa.

After the filling portion 60 has been formed in which the filler has been enclosed, the extending portion 25 is, for example, cut off.

In this way, the container 100 is obtained, in which the filler is enclosed in the filling portion 60. However, the extending portion 25 may remain even in a state of the container 100 in which the filler is enclosed.

After the container 100 has been produced, the contents 18 is filled into the containing portion 17 through the pouring cylindrical portion 15*a* of the spout member 15; and then the cap portion 70 is attached to the spout member 15, and thereby, the container 100 is obtained, in which the contents 18 is enclosed in the containing portion 17.

The present invention is not limited to the above-described embodiment, and includes modes such as various modifications and improvements as long as the object of the present invention is achieved.

For example, the container 100 may not include the inner bag 40. In this case, the containing portion 17 is formed by the container main body 20. In other words, in the peripheral edge sealing portion 19, one parts of the inside film layer 23 of the main-body forming sheet member 21 are attached to each other, thereby the container main body 20 is formed and also the containing portion 17 is composed.

However, for example, the external surface 151 of the plate portion 15*b* may be directly attached to the inside film layer 23 of the main-body forming sheet member 21, by the attached portion 91.

In addition, in the above description, the example has been described in which the container 100 is a pump container having the pump portion 72, but the container 100 may be other than the pump container. For example, the container 100 may have a cap (screw cap or the like) that closes the pouring cylindrical portion 15*a*.

In this case, the container 100 may be a form of having the bottom gusset 13 and standing by itself in such an attitude that the discharge port faces an upward direction, or may be a form of standing by itself in such an attitude that the discharge port faces a downward direction (inverted attitude). In the former case, similarly to the above embodiment, it can be suppressed that water or the like stays on an upper surface of the top gusset 14, and accordingly, it is possible to keep the upper surface of the top gusset 14 clean. In the latter case, the gusset portion having the discharge port can realize a satisfactory shape keeping property, and accordingly, the container 100 can ensure the stability of the inverted attitude.

In addition, the various constituent components of the container 100 do not need to exist independently; and it is allowed that a plurality of constituent components are formed as one member, that one constituent component is formed of a plurality of members, that a certain constituent component is a part of another constituent component, that a part of a certain constituent component overlaps a part of another constituent component, and/or the like.

REFERENCE SIGNS LIST

11 body portion
13 bottom gusset
14 top gusset
15 spout member
15*a* pouring cylindrical portion
15*b* plate portion
15*c* and 15*d* opening
17 containing portion
18 contents

19 peripheral edge sealing portion
20 container main body
20*a* first surface portion
20*b* second surface portion
21 main-body forming sheet member
22 outside film layer
23 inside film layer
24 non-attached region
26 and 28 main-body sealing portion
29*a* and 29*b* edge side portion
45 gusset portion peripheral edge sealing piece
45*a* first surface portion side sealing piece
45*b* second surface portion side sealing piece
46 lateral sealing piece
51 container forming sheet member
52 peripheral edge sealing portion
60 filling portion
61 first filling portion
61*a* and 61*b* first edge side filling portion
61*c* first adjacent filling portion
61*d* first lower edge filling portion
62 second filling portion
62*a* and 62*b* second edge side filling portion
62*c* second adjacent filling portion
62*d* second lower edge filling portion
64 gusset portion filling portion
91 attached portion
151 external surface
152 inner surface
100 container

The invention claimed is:

1. A container comprising:

a containing portion that accommodates contents; and a container main body that is composed of a main-body forming sheet member in which a plurality of film layers are laminated, and that surrounds the containing portion, wherein the container main body comprises a first surface portion, a second surface portion that is arranged so as to face the first surface portion with the containing portion being arranged therebetween, and a gusset portion that connects the first surface portion and the second surface portion to each other;

the gusset portion is provided with a discharge port that discharges the contents from the containing portion; and the main-body forming sheet member comprises a main-body sealing portion in which the plurality of film layers are attached to each other, and a non-attached region in which the plurality of film layers are partially non-attached to each other, and also comprises a filling portion in which a filler can be enclosed between layers of the plurality of film layers in the non-attached region, wherein the filling portion comprises a gusset portion filling portion that is arranged in the gusset portion; and the main-body sealing portion comprises a gusset portion peripheral edge sealing piece which is arranged along a peripheral edge of the gusset portion, and the gusset portion peripheral edge sealing piece defines an outer edge of the gusset portion filling portion.

2. The container according to claim 1, wherein the gusset portion peripheral edge sealing piece comprises a first surface portion side sealing piece that is arranged along a boundary between the gusset portion and the first surface portion, and a second surface portion side sealing piece that is arranged along a boundary between the gusset portion and the second surface portion; and the gusset portion filling portion is arranged from the first surface portion side sealing piece to the second surface portion side sealing piece.

3. The container according to claim 2, wherein the first surface portion side sealing piece comprises an attached portion between a peripheral edge portion of the gusset portion and a peripheral edge portion of the first surface portion, and the second surface portion side sealing piece comprises an attached portion between the peripheral edge portion of the gusset portion and a peripheral edge portion of the second surface portion.

4. The container according to claim 3, wherein the main-body forming sheet member is formed by laminating and attaching an outside film layer that constitutes an external surface side of the container main body and an inside film layer that constitutes an inner surface side of the container main body to each other.

5. The container according to claim 4, wherein the first surface portion side sealing piece has the main-body sealing portion that attaches the outside film layer and the inside film layer, along an inner edge of the attached portion between the peripheral edge portion of the gusset portion and the peripheral edge portion of the first surface portion; and the second surface portion side sealing piece has the main-body sealing portion that attaches the outside film layer to the inside film layer, along an inner edge of the attached portion between the peripheral edge portion of the gusset portion and the peripheral edge portion of the second surface portion.

6. The container according to claim 1, wherein the filling portion comprises:

a first adjacent filling portion that is formed in the first surface portion along the first surface portion side sealing piece; and a second adjacent filling portion that is formed in the second surface portion along the second surface portion side sealing piece.

7. The container according to claim 6, wherein the first adjacent filling portion and the gusset portion filling portion press each other in an inside of the container main body, and the second adjacent filling portion and the gusset portion filling portion press each other in an inside of the container main body.

8. The container according to claim 6, wherein the container main body comprises a pair of edge side portions that extend parallel to each other from a gusset portion side toward an opposite side; and the filling portion comprises a pair of first edge side filling portions that are formed in the first surface portion along each of the pair of edge side portions, and a pair of second edge side filling portions that are formed in the second surface portion along each of the pair of edge side portions, wherein one parts of the gusset portion filling portion are arranged in a vicinity of each of the pair of first edge side filling portions and in a vicinity of each of the pair of second edge side filling portions, respectively.

9. The container according to claim 8, wherein the first adjacent filling portion connects respective upper ends of the pair of first edge side filling portions, and the second adjacent filling portion connects respective upper ends of the pair of second edge side filling portions.

10. The container according to claim 6, wherein the first adjacent filling portion extends in an arc shape that is convex upward, and the second adjacent filling portion extends in an arc shape that is convex upward.

11. The container according to claim 1, wherein the container main body comprises a pair of edge side portions that extend parallel to each other, from the gusset portion side toward an opposite side, wherein the filling portion comprises a pair of first edge side filling portions that are formed in the first surface portion along each of the pair of edge side portions, and a pair of second edge side filling portions that are formed in the second surface portion along each of the pair of edge side portions, wherein one parts of the gusset portion filling portion are arranged in a vicinity of each of the pair of first edge side filling portions and in a vicinity of each of the pair of second edge side filling portions, respectively.

12. The container according to claim 11, wherein an upper end of the first edge side filling portion and the gusset portion filling portion press each other in an inside of the container main body, and an upper end of the second edge side filling portion and the gusset portion filling portion press each other in an inside of the container main body.

13. The container according to claim 1, further comprising a plate portion that is attached to the main-body forming sheet member, wherein the discharge port discharges the contents through an opening in a center of the plate portion.

14. The container according to claim 13, wherein an external surface of the plate portion is attached to an innermost layer of the main-body forming sheet member directly or indirectly with another sheet member in between.

15. The container according to claim 14, wherein in a state in which the filler is enclosed in the gusset portion filling portion, the main-body forming sheet member is folded from the external surface of the plate portion along an end surface of the plate portion, and is arranged so as to head further downward beyond the plate portion.

16. The container according to claim 1, further comprising an inner bag that is surrounded by the container main body, wherein the inner bag comprises the containing portion.

17. The container according to claim 1, wherein the filler is enclosed in the filling portion.

18. The container according to claim 17, wherein the gusset portion peripheral edge sealing piece includes a standing piece that stands toward the outside of the container main body.

19. The container according to claim 1, further comprising a cap portion that is attached to a discharge portion having the discharge port, wherein the cap portion comprises a pump portion, a dip tube that extends downward from the pump portion, and a head portion that is held by the pump portion so as to be movable up and down with respect to the pump portion.

20. A container comprising:

a containing portion that accommodates contents; and a container main body that is composed of a main-body forming sheet member in which a plurality of film layers are laminated, and that surrounds the containing portion, wherein the container main body comprises a first surface portion, a second surface portion that is arranged so as to face the first surface portion with the containing portion being arranged therebetween, and a gusset portion that connects the first surface portion and the second surface portion to each other;

the gusset portion is provided with a discharge port that discharges the contents from the containing portion; and the main-body forming sheet member comprises a main-body sealing portion in which the plurality of film layers are attached to each other, and a non-attached region in which the plurality of film layers are partially non-attached to each other, and also comprises a filling portion in which a filler can be enclosed between layers of the plurality of film layers in the non-attached region;

the filling portion comprises a gusset portion filling portion that is arranged in the gusset portion; and the container main body comprises:

a gusset portion peripheral edge sealing piece that comprises a first surface portion side sealing piece that includes an attached portion between a peripheral edge portion of the gusset portion and a peripheral edge portion of the first surface portion, and a second surface portion side sealing piece that includes an attached portion between a peripheral edge portion of the gusset portion and a peripheral edge portion of the second surface portion, and a pair of lateral sealing pieces that include an attached portion between the peripheral edge portion of the first surface portion and the peripheral edge portion of the second surface portion, wherein the gusset portion filling portion includes an inner edge on a side close to the discharge port, and extends downward from the inner edge toward an intersection point of the first surface portion side sealing piece, the second surface portion side sealing piece, and the lateral sealing piece.

* * * * *